United States Patent [19]

Ramsey

[11] Patent Number: 4,854,810

[45] Date of Patent: Aug. 8, 1989

[54] PARALLEL TRANSLATION MECHANISM

[75] Inventor: Keith E. Ramsey, Pleasant Lake, Mich.

[73] Assignee: Sellick Equipment Limited, Harrow, Ontario, Canada

[21] Appl. No.: 74,185

[22] Filed: Jul. 16, 1987

Related U.S. Application Data

[63] Continuation of Ser. No. 838,724, Mar. 11, 1986, abandoned.

[30] Foreign Application Priority Data

Jan. 20, 1986 [CA] Canada ..... 499855

[51] Int. Cl.[4] ..... B66F 9/06

[52] U.S. Cl. ..... 414/710; 414/718; 414/728; 91/170 R; 74/103

[58] Field of Search ..... 414/728, 718, 710, 706; 91/170 R; 74/103

[56] References Cited

U.S. PATENT DOCUMENTS

| | | | |
|---|---|---|---|
| 2,220,267 | 11/1940 | Nelson | 414/706 |
| 3,024,927 | 3/1962 | Quayle | 414/710 |
| 3,120,313 | 2/1964 | Ulinski | 414/710 |
| 3,680,881 | 8/1972 | Douglas | 74/103 X |
| 3,973,472 | 8/1976 | Russell, Jr. | 91/170 R X |
| 4,147,263 | 4/1979 | Frederick et al. | 414/718 |

*Primary Examiner*—Robert J. Spar
*Assistant Examiner*—Donald W. Underwood
*Attorney, Agent, or Firm*—Beveridge, DeGrandi & Weilacher

[57] ABSTRACT

A parallel translation mechanism, when connected between a first element and a second element, maintains the relative direction between the two elements constant when one of those elements is moved relative to the other. The mechanism is in part formed by first and second rigid elongated members which are pivotally connected together and are pivotally connected by the end of the first elongated member to one of the elements. A first portion of an extendable member is connected between the one of the elements and the second elongated member, and a second portion is connected between the other element and the second elongated member. The other element is also pivotally connected to a position on the second elongated member. The three members of the mechanism are connected together in such a fashion that the described relative movement between the two elements is obtained. The mechanism has particular application to forklift vehicles.

12 Claims, 7 Drawing Sheets

PARALLEL TRANSLATION MECHANISM

This application is a continuation of application Ser. No. 06/838,724, filed, Mar. 11, 1986, abandoned.

This invention relates to a parallel translation mechanism and more particularly, to a mechanism for maintaining a support platform for the boom of a forklift vehicle at a fixed angular orientation relative to the rest of the vehicle during longitudinal movement of the platform on the vehicle.

U.S. Pat. No. 4,147,263, granted to Frederick et al. on April 3rd, 1979, discloses a high-lift loader which comprises a vehicle having a longitudinally-extending frame and a transfer carriage mounted on the frame for longitudinal movement relative to the frame on longitudinal track rails. An extendable boom has its one end pivotally connected to the transfer carriage, its center connected by a hydraulic piston mechanism to the transfer carriage, and its other end adapted to hold a load. With the vehicle positioned in front of an elevated load deposition station, and the boom at a fixed orientation relative to the transfer carriage, the transfer carriage is moved forwardly on the stationary frame body of the vehicle to deposit the load at the elevated station. With this vehicle construction, large stresses are placed onto the longitudinally-extending track along which the transfer carriage moves. The subject invention is a linkage mechanism which has a similar capability of moving a support platform for a boom forwardly on a vehicle body while maintaining the angular orientation of the support platform constant relative to the vehicle body. The mechanism of the invention does not require the track rails of the loader of U.S. Pat. No. 4,147,263. Instead, the mechanism of the subject invention utilizes a series of rotating connecting links pivotally anchored to the frame of the vehicle such that the loading on the vehicle created by the weight of the boom and material supported on the end of the boom is distributed through the anchor positions on the vehicle frame.

In its broadest form, the subject invention is a mechanism for maintaining a link in a fixed angular orientation relative to a connected body during movement of the link relative to the body. The mechanism comprises, firstly, a first arm having its one end pivotally connected to a first position on the body so as to be rotatable around that one end. It secondly comprises a second arm pivotally connected generally centrally of its length to the other end of the first arm. One end of the second arm is restrained for movement generally along a line, a projection of which extends through the first position on the body. The other end of the second arm is pivotally connected to a first position on the link. The mechanism thirdly comprises a first extendable member having its one end pivotally connected to a second position on the link and its other end pivotally connected to a first generally central position on the second arm. The mechanism fourthly comprises a second extendable member having its one end pivotally connected to a second position on the body and its other end pivotally connected to a second generally central position on the second arm. The second extendable member is in an operative relationship with the first extendable member such that extension or contraction of the first extendable member results in a defined ratio of contraction or extension respectively of the second extendable member. Actuation of either the first or second extendable member to extend or contract that member results in the link moving relative to the body at the fixed angular orientation.

The first extendable member may be a first piston unit and the second extendable member may be a second piston unit. With such a construction, each piston unit comprises a cylinder, a piston slidable in the cylinder, and a rod connected to the piston and extending from an end of the cylinder. Each cylinder has an interior divided by the piston into a first chamber surrounding the piston rod and a second chamber on the opposite side of the piston. Either the first chambers or the second chambers of the two cylinders have a working fluid in flow communication such that working fluid leaving one cylinder enters the other cylinder. The one end of each extendable member may be the end of the piston rod of that member with the other end of each extendable member being the cylinder of that member. Alternatively, the one end of each extendable member may be the cylinder of that member with the other end of each extendable member being the end of the piston rod of that member. The first chambers of the two cylinders may have the working fluid in flow communication, with the piston units being actuated by varying the amount of a second working fluid in one of the second chambers of the two cylinders. Alternatively, the second chambers of the two cylinders may have the working fluid in flow communication, with the piston units being actuated by varying the amount of a second working fluid in one of the first chambers of the two cylinders.

The body to which the mechanism of the subject invention is connected may be a forklift vehicle body, and in such arrangement the mechanism may also comprise a forklift boom, one end of that boom being pivotally connected to a first position on the link. In such arrangement the mechanism also comprises a third extendable member having its one end pivotally connected to the boom and its other end pivotally connected to a second position on the link. The third extendable member may be a piston unit comprising a cylinder, a piston slidable in the cylinder, and a rod connected to the piston and extending from one end of the cylinder. The end of the rod and the cylinder form the two ends of the third extendable member.

The subject invention will now be more fully described by means of a preferred embodiment, utilizing the accompanying drawings, in which.

Figure 1:
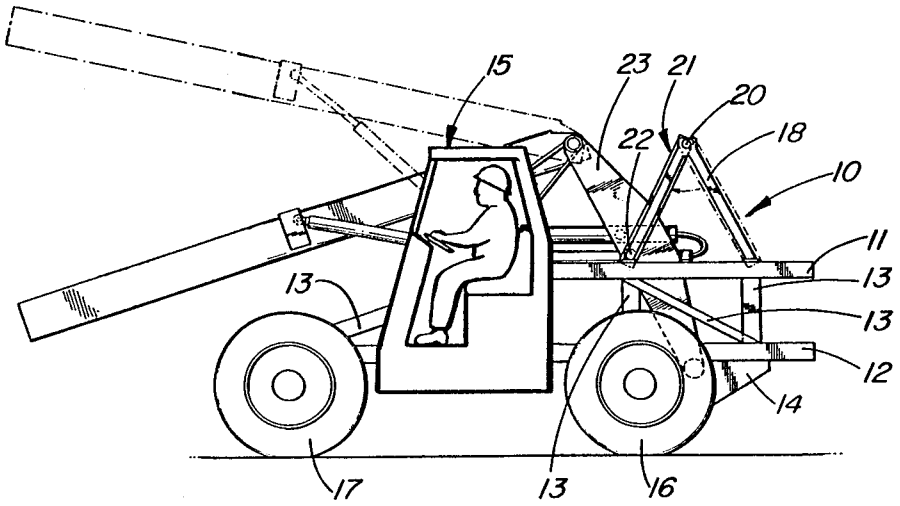
FIG. 1 is a side view of a forklift vehicle embodying the mechanism of the subject invention.

A forklift vehicle, generally designated 10 in FIG. 1, has an upper longitudinal frame member 11, a lower longitudinal frame member 12, and a series of vertical connecting frame members 13. A pair of heavy support plates 14, as illustrated in FIG. 1, extend downwardly from either side of frame member 12. A cab 15 is mounted on frame members 11 and 12 so as to be laterally offset from the longitudinal centreline of the vehicle. The vehicle has a pair of rear wheels 16 connected to an engine (not shown) mounted on the frame of the vehicle and also has a pair of front wheels 17. Both pairs of wheels are independently steerable through a hydraulic system (see FIG. 5) such that the vehicle may either turn on a sharp radius with the front and rear wheels both being tangent to the same circle, or may move at an angle with the front and rear wheels being parallel to each other.

Figure 5:
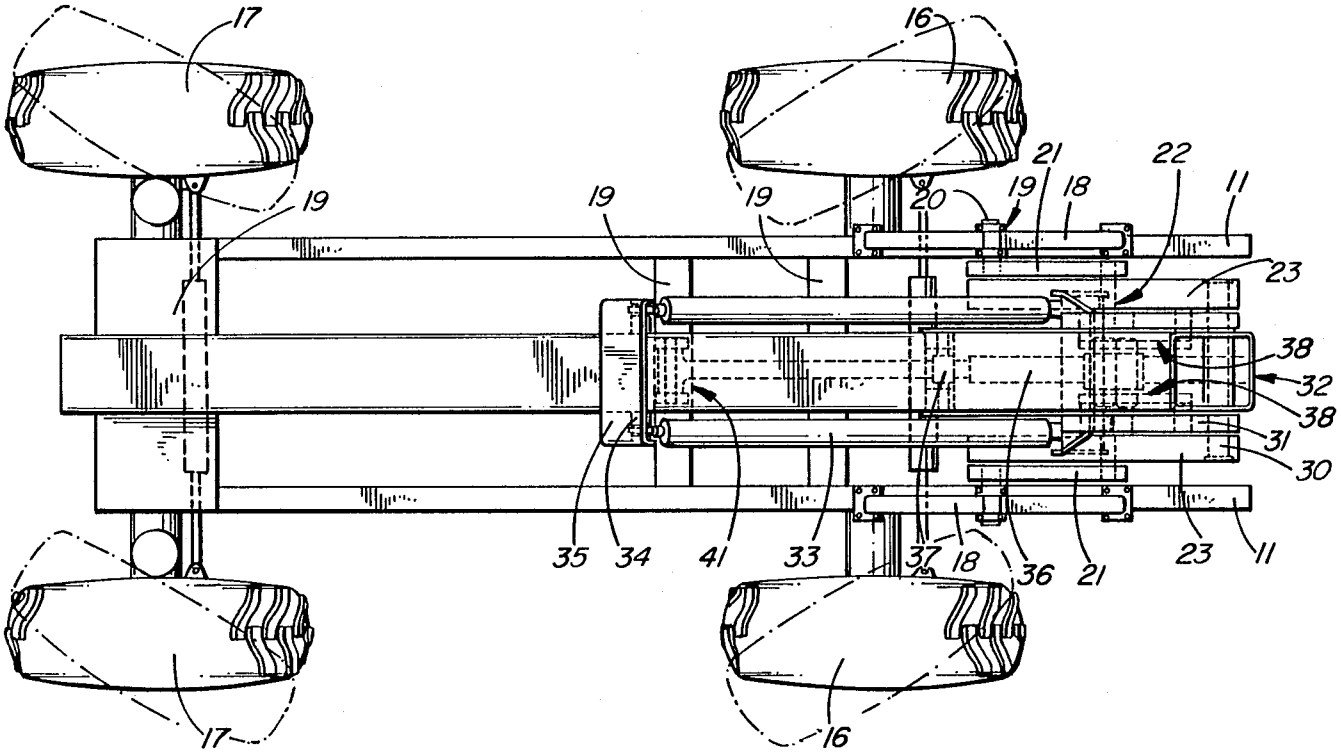
FIG. 5 is a plan view of the forklift vehicle of FIG. 3.

On each side of the vehicle approximately above the rear wheels 16, an A-frame member 18 is secured to the respective upper longitudinal frame member 11. As can be seen in the drawings, A-frame member 18 is secured to upper longitudinal frame member 11 proximate of the positions on frame member 11 from which a pair of the vertical connecting frame members 13 extend to frame member 12. The remaining portion of the frame of the vehicle consists of a series of lateral frame members 19, as illustrated in FIG. 5.

Figure 2:
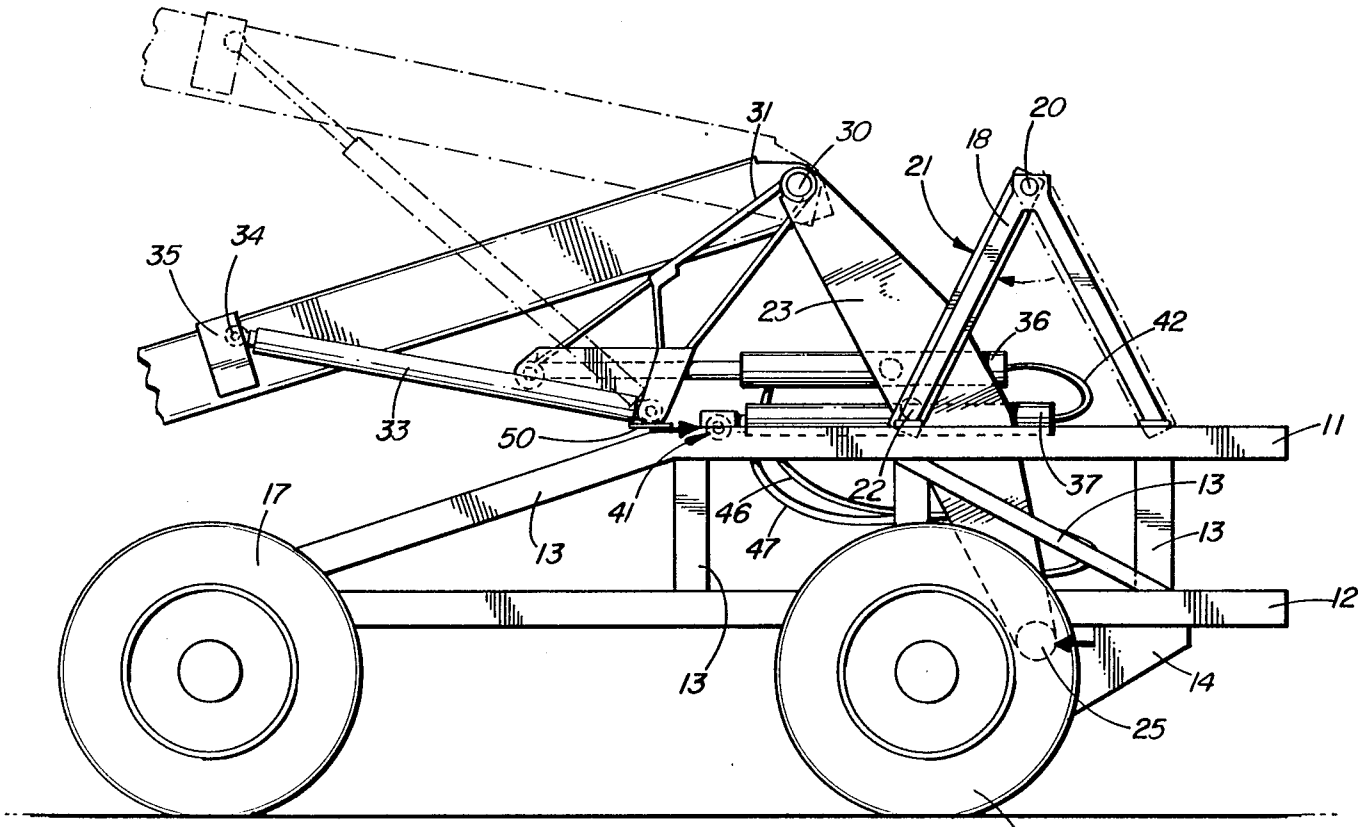
FIG. 2 is a side view of the vehicle of FIG. 1 with the operator's cab removed for clarity, the mechanism of the subject invention being in the most forward position.
Figure 7:
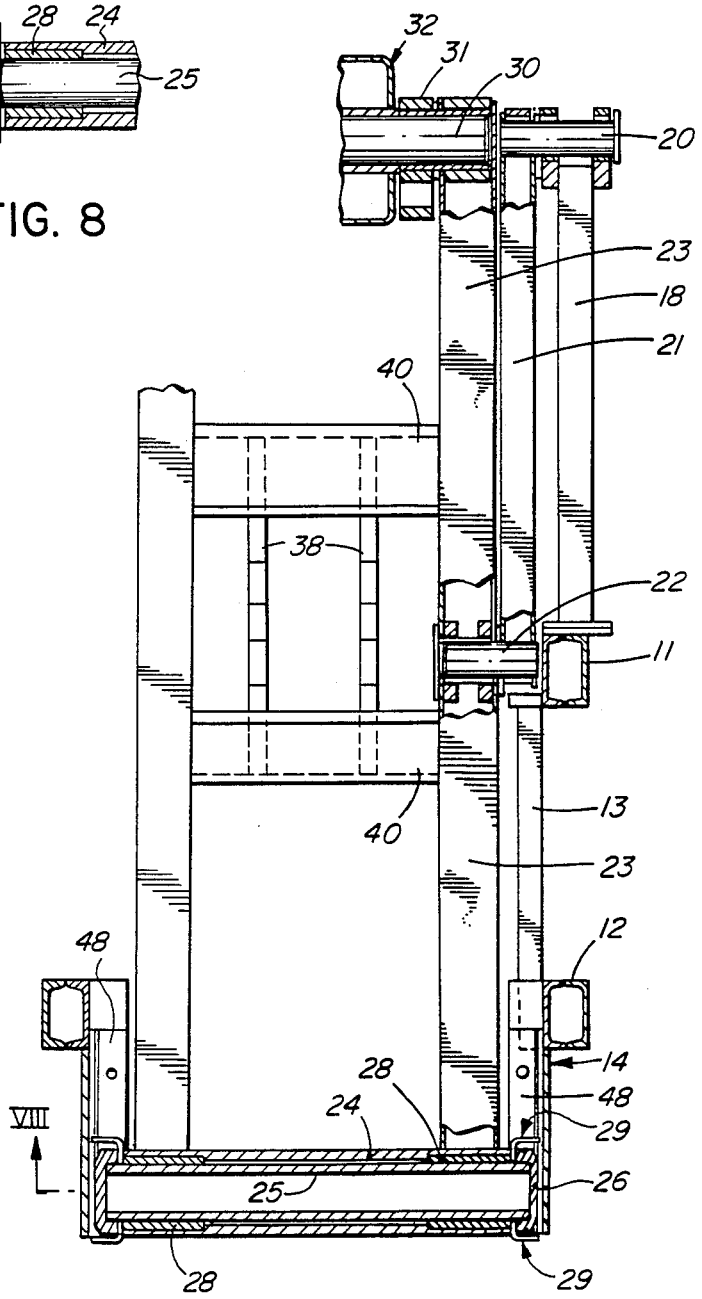
FIG. 7 is a partially-sectioned end view of the linkages on one side of the vehicle of FIG. 1, that view being taken along line VII—VII of FIG. 4.

Pivotally connected to the apex of each A-frame member 18 is a support axle 20, the axes of rotation of the two support axles 20, being in-line with each other. Each of the support axles 20 extends into one end of a pivotal link 21, from the other end of which, and on the other side of which, a second support axle 22, extends parallel to support axle 20. Support axle 22 extends into a bearing centrally positioned on the cantilever member 23, the bearing being located proximate of the longest straight edge of the cantilever member 23 as shown in FIGS. 1 and 2. As shown in FIG. 7, the one end of the pair of cantilever members 23 are connected by a tubular member 24 which extends around an elongated roller member 25. Roller member 25 is constrained to move such that a cap 26 positioned over each of its ends rolls in a respective one of a pair of channels 27 extending normal to the base plane of the vehicle. An annular bearing 28 extends between each end of the tubular member 24 and the adjacent end of elongated roller member 25. Each end of roller member 25 has a dirt cover 29 fitted over it, each dirt cover 29 being held between tubular member 24 and the respective cap 26. Pivotal link 21 may assume any orientation between the two extremes shown in FIG. 2 and 3; for instance, it may assume the central position shown in FIG. 4. Correspondingly, cantilever member 23 may assume any of the positions illustrated in FIGS. 2, 3 and 4 as well as any positions intermediate of those shown.

Figure 3:
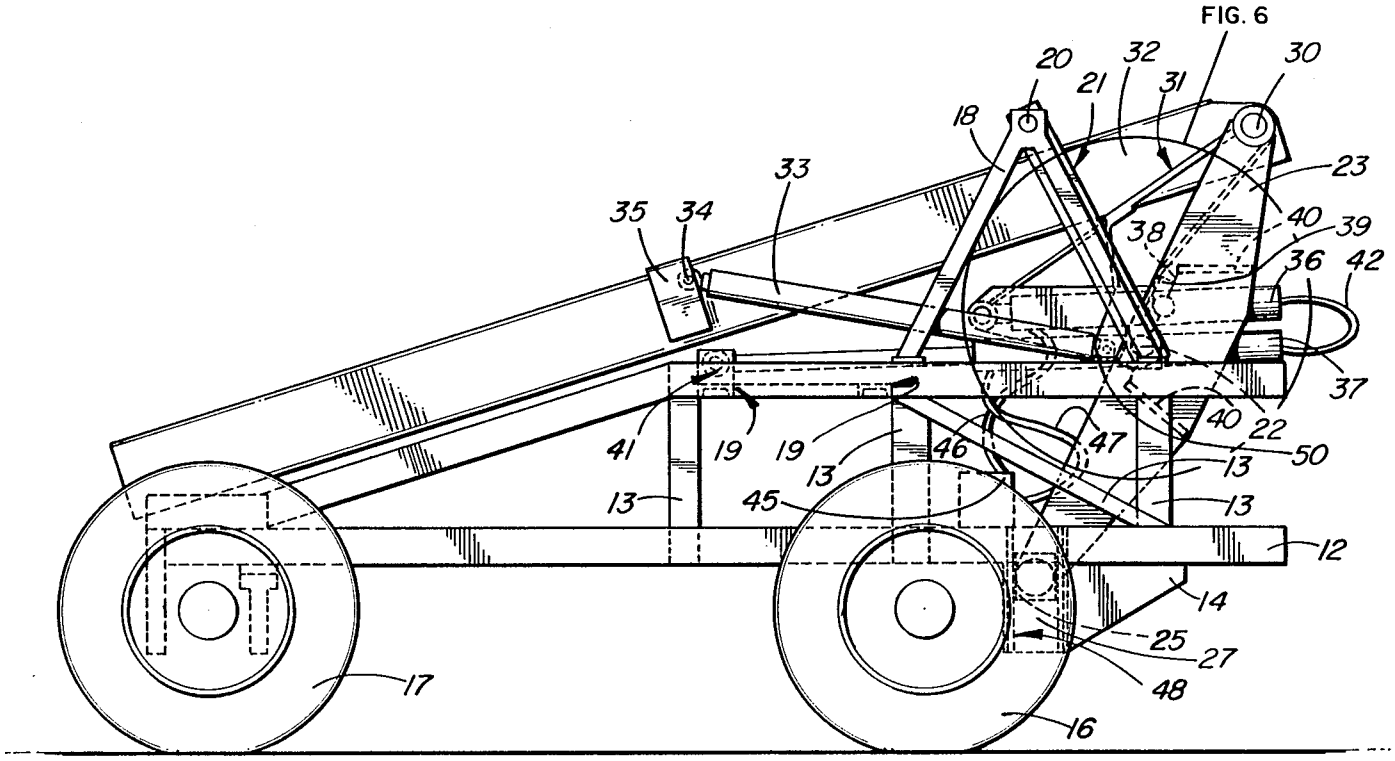
FIG. 3 is a side view of the vehicle of FIG. 1 with the operator's cab removed for clarity, the mechanism of the subject invention being in the most rearward position.
Figure 4:
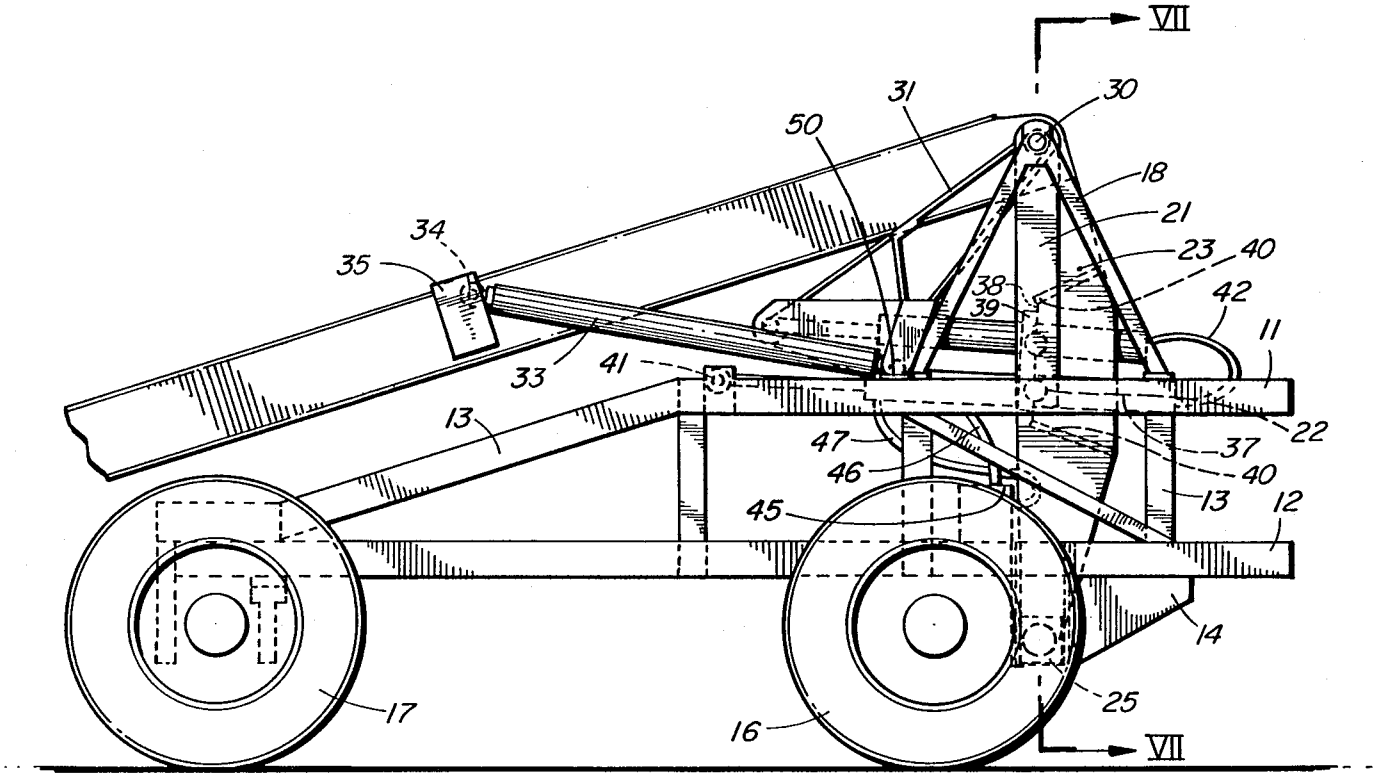
FIG. 4 is a side view of the vehicle of FIG. 1 with the operator's cab removed for clarity, the mechanism of the subject invention being in an intermediate position between those shown in FIGS. 2 and 3.

With reference to FIG. 3, pivotal link 21 is connected to a position on cantilever member 23 such that the distance between the axis of rotation of support axle 20 and the axis of rotation of support axle 22 is the same distance as that between the axis of rotation of support axle 22 and the axis of rotation of a support axle 30 extending from the other end of cantilever member 23. As can be seen in FIG. 5, support axle 30 extends between the pair of cantilever members 23 and, intermediate of members 23, extends through a first corner of a pair of triangular members 31 as well as through the centrally-positioned one end of a boom 32. Extending between a second position on boom 32 and a second corner of each of the triangular members 31 is a pair of hydraulic piston members 33, as shown in FIGS. 3 and 5. The cylinder end of each hydraulic piston member 33 is pivotally connected to the respective one of the triangular members 31, and the piston rod end of piston member 33 is pivotally connected to a cylindrical bar 34 extending through boom 32 and covered by a housing 35. Actuation of hydraulic piston member 33 changes the relative angular orientation between the pair of triangular members 31 and boom 32.

Figure 6:
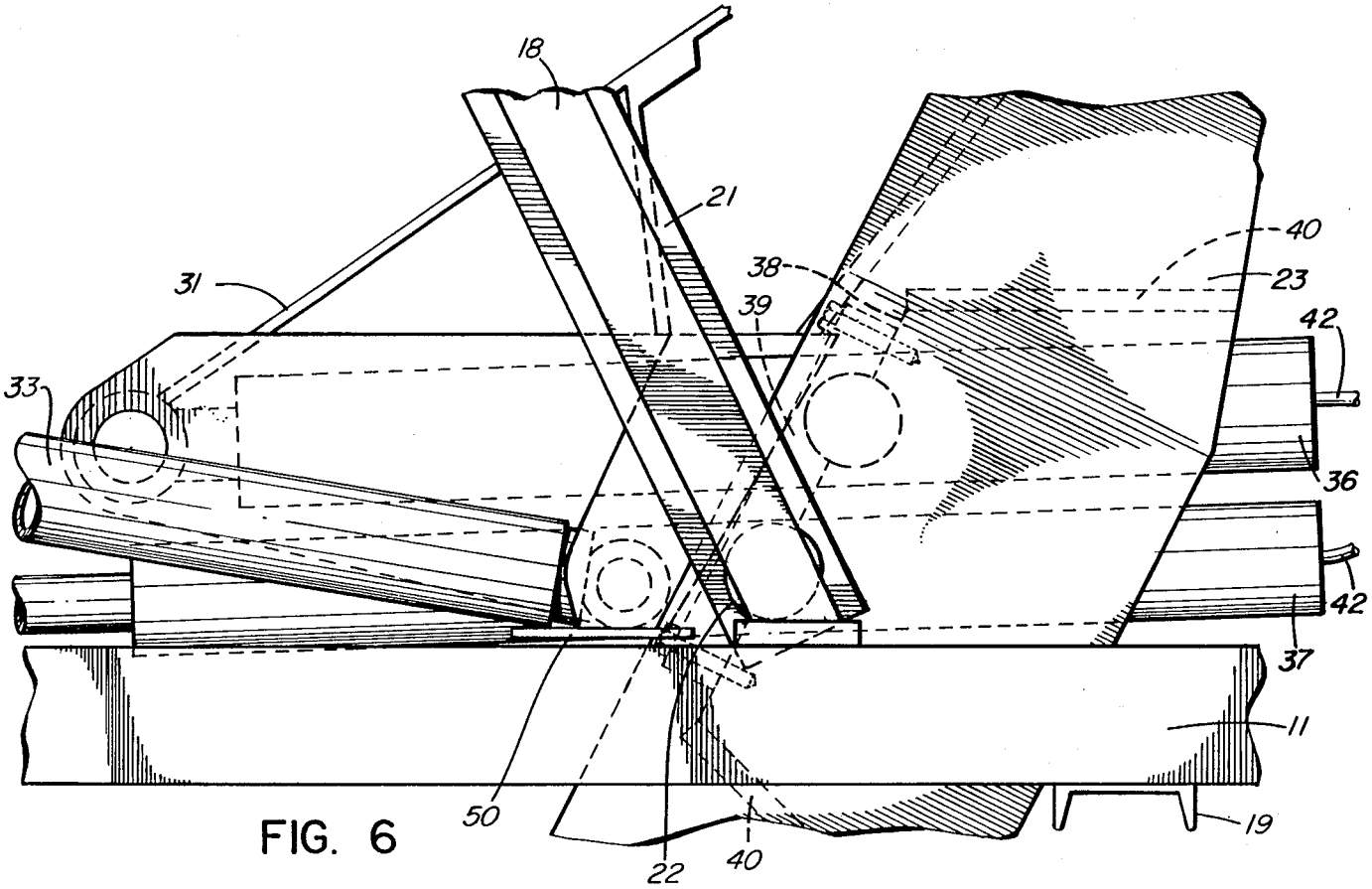
FIG. 6 is an enlargement of the circled portion of FIG. 3.

An upper hydraulic piston member 36 and a lower hydraulic piston member 37 have their cylinders pivotally held at a central position thereon between a pair of plates 38, extending parallel to and positioned between cantilever members 23, and a plate 39 bolted to the end of the plates 38. Each plate 38 is secured between two flanges 40, as shown in FIGS. 6 and 7. Thus, the piston members 36 and 37 move longitudinally on the vehicle as the cantilever members 23 pivot. The piston rod of piston member 37 has its outer end pivotally connected to a bracket 41 mounted on one of the lateral frame members 19, as shown in FIGS. 3 and 5. The outer end of the piston rod of piston member 36 is pivotally connected to the third corner of the triangular members 31, as can best be seen in FIG. 2. A flexible hydraulic hose 42 allows hydraulic fluid to flow between the one ends of the cylinders of piston members 36 and 37. The effect of that arrangement is that the piston rod of piston member 36 is forced from its cylinder as the piston rod of piston member 37 enters its cylinder. When cantilever member 23 pivots between the two extreme positions shown in FIGS. 2 and 3, it will be appreciated that the cylinder of piston member 37 moves a greater distance longitudinally on the frame of the vehicle than does the cylinder of piston member 36; that results from the fact that piston member 36 revolves about support axle 30 whereas piston member 37 revolves around that end of the cantilever member 23 that slides in channel 27. To compensate for the greater distance travelled by the cylinder of piston member 37 over that travelled by the cylinder of piston member 36, the diameter of the cylinder of piston member 36 is made correspondingly greater than the diameter of the other cylinder. The ratio of the cylinder diameters is made such that triangular members 31 are maintained at a constant angular orientation relative to the base of vehicle 10 for all longitudinal positions of the triangular members 31.

A control system actuates the mechanism of the invention by pumping hydraulic oil into the piston rod end of the cylinder of one of piston members 36 and 37, that oil being drawn from a reservoir into which oil is simultaneously expelled from the piston rod end of the other cylinder. At equilibrium and without any hydraulic actuation, cantilever member 23 sits in the generally vertical orientation illustrated in FIG. 4. When hydraulic oil is pumped into the piston rod end of the cylinder of piston member 36, oil on the other side of the piston of piston member 36 is forced through hose 42 into piston member 37. Cantilever member 23 moves from the generally vertical equilibrium position to the positiion illustrated in FIG. 3. Hydraulic oil is thereby forced out of the piston rod end of piston member 37 and stored in an oil reservoir. When it is desired to move cantilever member 23 from its generally vertical equilibrium position to the position illustrated in FIG. 2, hydraulic oil is pumped into the piston rod end of piston member 37, oil on the other side of the piston of piston member 37 then passes through hose 42 into piston member 36, and oil on the other side of the piston of piston member 36 is forced into the oil reservoir. With reference to FIG. 3, a hydraulic unit 45 is shown connected to hoses 46 and 47 which are entering respectively the piston rod ends of the cylinders of piston members 36 and 37. A control valve in hydraulic unit 45 can assume two positions; in one position it connects hose 46 to the pump of hydraulic unit 45 and also connects hose 47 to the reservoir, and in another position it connects hose 47 to the pump and also connects hose 46 to the reservoir. Actuation of that control valve results in cantilever member 23 moving from the position illustrated in FIG. 4 to one of the positions illustrated in FIGS. 2 and 3.

With respect to FIGS. 2 and 3, triangular member 31 maintains a constant angular orientation relative to the frame of the vehicle during rotation of cantilever member 23. It should be pointed out that support axle 30 and thus the one end of boom 32 moves in a line parallel to longitudinal frame members 11 and 12 of the vehicle; that results from the axis of rotation of support axle 22 being equidistant from the axis of rotation of support axle 20 and the axis of rotation of support axle 30.

Figure 8:
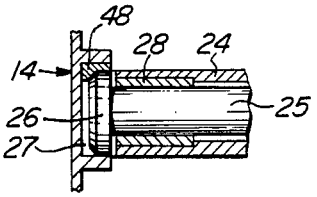
FIG. 8 is a partially-sectioned view of a portion of the linkage mechanism illustrated in FIG. 7, that view being along VII in FIG. 7.

Triangular members 31 are thus maintained at the same angular orientation relative to the frame of the vehicle no matter what position they assume longitudinally on the vehicle. As mentioned, that is in part accomplished by making the diameter of the cylinder of piston member 37 correspondingly smaller than the diameter of the cylinder of piston member 36. Triangular members 31 act as a longitudinally-movable base for the boom 32. If piston members 33 are not activated, boom 32 maintains a fixed angular orientation relative to the frame of the vehicle as it is moved longitudinally on that frame by the operation of hydraulic unit 45. Whether or not boom 32 is in its raised position, the loading on A-frame member 18 is constant; that constant load amounts to a vertical force of magnitude equal to the aggregate weight of the linkage assembly (including boom 32) and the load being carried on the outer end of boom 32. The large moment created when boom 32 is raised is offset entirely by a moment comprised of longitudinal reaction forces acting on bracket 41 and roller member 25 (as illustrated by the heavy arrows in FIG. 2). As illustrated in FIG. 8, the caps 26 are chamfered and rest in a complementary channel that extends along a high-strength member 48. As the cantilever members 23 rotate the caps 26 roll along the members 48. The heavy forces that may act on slide member 25 are transmitted to the frame through the members 48 in the channels 27. The linkage mechanism is stabilized both laterally and longitudinally on the vehicle frame by the presence of the high-strength members 48.

Various safety devices are built into the subject lifting apparatus. FIG. 6 illustrates one such device. A plate 50 is fitted to the third corner of each of the triangular members 31, each plate 50 maintaining a small clearance above the adjacent longitudinal frame member 11 for all longitudinal positions of the associated triangular member 31. The presence of plates 50 ensures that boom 32 will move only slightly downward (until plates 50 engage the adjacent frame members 11) if the hydraulic system for actuating the linkage should fail. Each plate 50 could be replaced by a wheel pivotally connected to the third corner of the respective triangular member 31 and adapted to ride along the adjacent longitudinal frame member 11; such arrangement is not illustrated. A further feature that is incorporated into the control system of the apparatus involves monitoring the pressure of the working fluid sitting in the one end of the cylinders of piston members 36 and 37 and adapted to flow through hose 42. That monitoring is accomplished by placing a T-connection in hose 42 so that a pressure monitoring device can monitor the pressure in that hose. If the pressure in that hose should exceed a defined limit, valves can be set to automatically actuate to release hydraulic oil from or to pump oil into the one end of piston members 36, 37.

It will be appreciated that only one preferred embodiment has been described for the invention and that the invention has other applications besides that described in the preferred embodiment.

I claim:

1. A mechanism for maintaining a link in a fixed angular orientation relative to a connected body during movement of the link relative to the body, the mechanism comprising:

(a) a first arm having its one end pivotally connected to a first position on the body so as to be rotatable around that one end;

(b) a second arm pivotally connected generally centrally of its length to the other end of the first arm, one end of the second arm being restrained for movement generally along a line, a projection of that line extending through the first position on the body, the other end of the second arm being pivotally connected to a first position on the link;

(c) a first extendable member having its one end pivotally connected to a second position on the link and its other end pivotally connected to a first generally central position on the second arm;

(d) a second extendable member having its one end pivotally connected to a second position on the body and its other end pivotally connected to a second generally central position on the second arm, the second extendable member being in an operative relationship with the first extendable member such that extension or contraction of the first extendable member results in a defined ratio of contraction or extension respectively of the second extendable member; and (e) a control system for controlling extension or contraction of the extendable members, said control system including a first active hydraulic system for extending or contracting one of the extendable members and a second passive hydraulic system for extending or contracting the other extendable member and for maintaining the defined ratio of the extendable members; whereby actuation of either the first or second extendable member to extend or contract that member results in movement of the link relative to the body at the fixed angular orientation.

2. A mechanism as in claim 1, wherein the first extendable member is a first piston unit and the second extendable member is a second piston unit, each piston unit comprising a cylinder, a piston slidable in the cylinder, and a rod connected to the piston and extending from an end of the cylinder, each cylinder having an interior divided by the piston into a first chamber surrounding the piston rod and a second chamber on the opposite side of the piston, either the first chambers or the second chambers of the two cylinders having a working fluid in flow communication such that working fluid leaving one cylinder enters the other cylinder.

3. A mechanism as in claim 2, wherein the one end of each extendable member is the end of the piston rod of that member and the other end of each extendable member is the cylinder of that member.

4. A mechanism as in claim 2, wherein the one end of each extendable member is the cylinder of that member and the other end of each extendable member is the end of the piston rod of that member.

5. A mechanism as in claim 2, 3, or 4, wherein the first chambers of the two cylinders have the working fluid in flow communication and wherein the piston units are actuated by varying the amount of a second working fluid in one of the second chambers of the two cylinders.

6. A mechanism as in claim 2, 3, or 4, wherein the second chambers of the two cylinders have the working fluid in flow communication and wherein the piston units are actuated by varying the amount of a second working fluid in one of the first chambers of the two cylinders.

7. A mechanism as in claim 1, wherein the connected body is a forklift vehicle body, and also comprising a forklift boom, one end of the boom being pivotally connected to a first position on the link, and further comprising a third extendable member having its one end pivotally connected to the boom and its other end pivotally connected to a second postion on the link.

8. A mechanism as in claim 7, wherein the third extendable member is a piston unit comprising a cylinder, a piston slidable in the cylinder, and a rod connected to the piston and extending from one end of the cylinder, the end of the rod and the cylinder being the two ends of the third extendable member.

9. A boom displacement mechanism for a forklift vehicle, the displacement mechanism being adapted to move the forklift boom longitudinally on the body of the forklift vehicle, the displacement mechanism comprising:

(a) a first arm pivotally connected at its one end to a first position on the body;

(b) a second arm pivotally connected intermediate of its ends to the other end of the first arm, one end of the second arm being constrained to move in a linear path in-line with the first position on the body;

(c) a link pivotally connected at a first position thereon to the other end of the second arm, the forklift boom being connected to the link;

(d) a first piston unit having a cylinder, a piston slidable in the cylinder, and a rod connected to the piston and extending from one end of the cylinder, one end of the first piston unit being pivotally connected to a generally central position on the second arm and the other end of the first piston unit being pivotally connected to a second position on the body;

(e) a second piston unit having a cylinder, a piston slidable in the cylinder, and a rod connected to the piston and extending from one end of the cylinder, one end of the second piston unit being pivotally connected to a generally central position on the second arm and the other end of the second piston unit being pivotally connected to a second position on the link, the second piston unit extending generally parallel to the first piston unit, a working fluid in the two piston units being in flow communication such that movement of one piston into or out of its cylinder results in a corresponding movement of the other piston out of or into its cylinder respectively; and (f) a control system to control relative movement between the pistons and cylinders of the piston units, said control system including a first active hydraulic system to move one of the pistons and a second passive hydraulic system to move the other piston and to maintain the defined ratio of the pistons, wherein the first and second piston units are sized such that the link is maintained at a constant angle relative to the vehicle body during the longitudinal movement of the forklift boom relative to the vehicle body.

10. A boom displacement mechanism as in claim 9, wherein the forklift boom is pivotally connected to the link, the mechanism also comprising a third piston unit having a cylinder, a piston slidable in the cylinder, and a rod connected to the piston and extending from one end of the cylinder, one end of the third piston unit being pivotally connected to a second position on the boom and the other end of the third piston unit being pivotally connected to the link.

11. A boom displacement mechanism as in claim 10, wherein the axis about which the forklift boom pivots relative to the link is the same axis about which the link pivots relative to the second arm.

12. A mechanism for maintaining a link in a fixed angular orientation relative to a connected body during movement of the link relative to the body, the mechanism comprising:

(a) a first arm having its one end pivotally connected to a first position on the body so as to be rotatable around that one end;

(b) a second arm pivotally connected generally centrally of its length to the other end of the first arm, one end of the second arm being restrained for movement generally along a line, a projection of that line extending through the first position on the body, the other end of the second arm being pivotally connected to a first position on the link;

(c) an extension mechanism pivotally connected to the second arm at a first generally central position on the second arm, the extension mechanism having a first extendable member connecting with a second position on the link, and the extension mechanism also having a second extendable member connecting with a second position on the body, the first extendable member being in an operative relationship with the second extendable member such that extension or contraction of the first extendable member results in a defined ratio of contraction or extension respectively of the second extendable member; and (d) a control system for controlling extension or contraction of the extendable members, said control system including a first active hydraulic system for extending or contracting one of the extendable members and a second passive hydraulic system for extending or contracting the other extendable member and for maintaining the defined ratio of the extendable members, whereby actuation of the extension mechanism by either extending or contracting the first or second extendable members results in movement of the link relative to the body at the fixed angular orientation.

* * * * *